US010546703B1

(12) United States Patent
Joo

(10) Patent No.: US 10,546,703 B1
(45) Date of Patent: Jan. 28, 2020

(54) BI-STABLE COMPLIANT SWITCH SYSTEM

(71) Applicant: Government of the United States, as represented by the Secretary of the Air Force, Wright-Patterson AFB, OH (US)

(72) Inventor: James J. Joo, Centerville, OH (US)

(73) Assignee: United States of America as represented by the Secretary of the Air Force, Wright-Patterson AFB, OH (US)

( * ) Notice: Subject to any disclaimer, the term of this patent is extended or adjusted under 35 U.S.C. 154(b) by 0 days.

(21) Appl. No.: 15/899,467

(22) Filed: Feb. 20, 2018

(51) Int. Cl.
*H01H 21/44* (2006.01)
*H01H 3/46* (2006.01)
*H01H 13/38* (2006.01)
*H01H 5/18* (2006.01)

(52) U.S. Cl.
CPC ..... *H01H 21/44* (2013.01); *H01H 3/46* (2013.01); *H01H 5/18* (2013.01); *H01H 13/38* (2013.01)

(58) Field of Classification Search
CPC ..... H01H 21/44; H01H 13/38; H01H 3/46; H01H 5/18
USPC ..... 200/400–402, 405, 408, 409, 447–452, 200/454, 456, 458–461, 468, 61.45 R, 200/61.52, 401
See application file for complete search history.

(56) References Cited

U.S. PATENT DOCUMENTS 1,668,974 A 5/1928 Mottlau
2,658,972 A 11/1953 Brown
3,403,236 A 9/1968 Zolodow
3,694,607 A 9/1972 Fontana
3,873,078 A 3/1975 Wolf
4,054,766 A 10/1977 Kramer
4,332,991 A 6/1982 Nordstrom
4,420,659 A 12/1983 Neyret
4,891,481 A * 1/1990 Comerford ..... H01H 13/36 200/405
6,175,170 B1 1/2001 Kota et al.
6,215,081 B1 4/2001 Jensen et al.
2008/0258366 A1 10/2008 Tuttle
2010/0138002 A1 6/2010 Mankame et al.
2013/0047523 A1 2/2013 Chen et al.
2014/0306576 A1 10/2014 Ervin et al.

OTHER PUBLICATIONS

F. Pieri, M. Piotto; A micromachined bistable 1×2 switch for optical fibers; Microelectronic Engineering 53 (2000) pp. 561-564.

(Continued)

*Primary Examiner* — Edwin A. Leon
*Assistant Examiner* — Lheiren Mae A Caroc
(74) *Attorney, Agent, or Firm* — Matthew D. Fair; AFMCLO/JAZ

(57) ABSTRACT

A switch mechanism has a compliant buckling bar that includes a single fixed end mounted to a mounting surface and a free end that is displaced with respect to the fixed end. The mounting of the fixed end to the mounting surface may constitute the only fixed connection between the bar and the mounting surface. The bar moves between two stable positions in response to a transition force applied transversely to the free end. Residual stress in the bar may be higher when the free end is at each of the stable positions than when the free end is at a neutral position located between the stable positions.

13 Claims, 5 Drawing Sheets

(56) References Cited

OTHER PUBLICATIONS

Kevin M. Walsh; Usha R. Gowrishetty; No-Power Mems Devices using Buckled Diaphragms and Engineered Stress; University of Louisville, Louisville, USA; 2010 IEEE; (2 pgs.).
Shannon A. Zirbel, Kyler A. Tolman, Brian P. Trease and Larry L. Howell; Bistable Mechanisms for Space Applications; PLOs One DOI:10.1371/journal.pone.0168218; Dec. 28, 2016; p. 1-18.
Intro to Compliant Mechanicms/Compliant Mechanisms; BYU Mechanical Engineering; Sep. 22, 2017; https://compliantmechanisms.byu.edu/content/intro-compliant-mechanisms; (8 pgs.).
OMRON; Toggle Switches Part 2 OMRON Switches; Switch Basics; Switches; Products; OMRON Electronic Components Web; Sep. 20, 2017; https://www.omron.com/ecb/products/sw/special/switch/basic02-06.html (3 pgs.).

* cited by examiner

BI-STABLE COMPLIANT SWITCH SYSTEM

GOVERNMENT INTEREST

The conditions under which this invention was made are such as to entitle the Government of the United States under paragraph 1(a) of Executive Order 10096, as represented by the Secretary of the Air Force, to the entire right, title and interest therein, including foreign rights.

FIELD OF THE INVENTION

The present invention relates generally to bi-stable switches. More particularly, the present invention relates to a buckling-type compliant switch having two stable positions.

BACKGROUND

Bi-stable switches are switches that are capable of remaining in one of two positions or stable states without requiring energy input to maintain those states. The stable states often correspond to the function of the switch. For example, switches may be used to open an electrical circuit in one stable position and to close the circuit in a second stable position. Correctly and consistently positioning and holding a switch at its stable states and switching between the stable states is often a critically important component of the switch design. This ensures that the switch functions reliably for its intended purpose. For example, in the case of an electrical switch, where the position of the switch governs whether an electrical circuit is open or closed, correctly orienting and holding the switch at the selected stable position is important to ensure that an "ON" switch remains in the on position and an "OFF" switch remains in the off position until moved by the user. For the same reason, it is also important that the switch does not move past or over the desired stable state position. Rather, it is important for movement of the switch to cease precisely at the stable positions.

Typically, transition between the stable states of a bi-stable switch is achieved by a single actuation of energy. The type and magnitude of actuation energy for transition between stable states can be modified according to the type and function of the switch as well as the environment in which it is intended to be operated. For example, a bi-stable switch in a mechanical system may have different requirements for type and magnitude of transition or actuation energy from switches in electrostatic, magnetic, thermal, and pneumatic applications.

Historically, there have been several methods for sustaining the stable state, including using latches, living hinges, hooks, and residual stress. Alternatively, in buckling-type, bi-stable mechanisms, the device is located and held at the stable states without any further input of energy as a result of residual stress in a structural member of the device.

Buckling is an instability or failure mode that may occur when a structural member is placed under sufficient compressive stress. The compressive stress required for buckling to occur is known as the "critical load." At the critical load, the structure becomes unstable and the introduction of the slightest force will cause the structure to buckle. Buckling is characterized by a sudden transverse deflection ("jumping") of the structural member once the critical load has been reached from one configuration to another configuration. The critical load is inversely related to the unsupported length of the structural member. As the unsupported length increases, the load necessary for buckling to occur decreases. Likewise, as the unsupported length decreases, the load necessary for buckling to occur increases. Accordingly, the critical load may be adjusted by increasing or decreasing the unsupported length of the structural member.

The term "structural member" refers to a portion of the switch that moves between a first stable position and a second stable position. The structural member of a bi-stable, buckling-type switch can be in the form of a beam that bends in one direction to the first stable position and bends in a second direction to the second stable position. As discussed above, this type of device utilizes a mode of failure (i.e., buckling) that results from structural instability from forces, such as compression acting on a structural member, to create the necessary residual stress. For example, in some cases, residual stress is the result of material deformation. The residual stress is confined so that the resulting pressure holds the structural member at a stable state with no further input of energy required.

Typical buckling-type, bi-stable mechanisms require the structural member to be fixed at two points to enable the creation of residual stress in the structural member and to correctly and reliably move between the two stable states. More specifically, many bi-stable devices include a structural member (i.e., a beam) where each end is fixed and a transition force is applied transversely at some location between those fixed points or is applied axially at one end of the device and along an axis that runs between both fixed points. In either case, once a sufficient transition force is applied, the structural member buckles and then moves from one stable position to another stable position. As discussed above, this change in stable states is typically manifested by the beam moving from bowing in one direction to bowing in the opposite direction.

However, having a structural member fixedly mounted at both ends is not always desired. In certain instances, for example, it may desirable to have a structural member having a free end to simplify the manufacturing or operation of the device. Another problem often caused by fixing both ends of a beam in buckling-type, bi-stable device is instability. In a flexible beam having both ends fixedly mounted, the stable position is not symmetric. Moving a portion of the beam past the mid-point between the two bowed positions does not guarantee that the beam will move to and remain at the second stable bowed position. In fact, it may very easily return back to the original stable position. Thus, switching a beam between stable positions, where both ends of the beam are fixed, can sometimes be inconsistent.

Additionally, overloading and failure of the beam often occurs when both ends are fixed. Typically, when manufacturing a bi-stable switch, the structural member is fabricated so that it is longer than the distance between the two fixation points. Thus, the beam is placed under compression in order to provide the bowed shape and to fix both ends at the fixation points. This preloading combined with the additional transitional forces may cause the beam to be overloaded and to fail prematurely. Thus, the useful life of the beam fixed at both ends may be limited due to overloading.

For the reasons discussed above, reliably or consistently moving to the same stable position is an important characteristic of many bi-stable devices. Certain prior devices have required surface etching or other types of surface manipulation to repeatedly achieve stable state positioning with accuracy. Other devices require additional components, such as hinges, etc., to enable reliable movement between stable positions However, these additional features increase the cost and complexity of the device and may also cause the functional life of the product to be shortened.

Accordingly, what is needed is a bi-stable switch that is easier to manufacture and to operate and that may be consistently and repeatedly positioned in two stable configurations.

SUMMARY OF THE INVENTION

The above and other needs are met by a switch mechanism having a compliant buckling bar. The bar includes a single fixed end that mounts to a mounting surface and a free end that is displaced with respect to the fixed end. In some embodiments, mounting the fixed end to the mounting surface constitutes the only fixed connection between the bar and the mounting surface. The bar moves between two stable positions in response to a transition force applied transversely to the free end. In some embodiments, residual stress in the bar is higher when the free end is at each of the stable positions than when the free end is at a neutral position located between the stable positions.

In some embodiments, the switch mechanism includes a restriction member that is spaced apart from the free end of the bar. The fixed end of the bar is positioned between the restriction member and the free end of the bar. The switch mechanism further includes arms that each have first ends that are connected to the restriction member and second ends that are connected to the bar proximate the free end. A central space is defined within the arms and the restriction member. The fixed end of the bar is located in the central space. In some embodiments, as the arms and the free end of the bar are moved with respect to the fixed end of the bar, the restriction member is also displaced with respect to the fixed end of the bar. In certain embodiments, displacing the free end of the bar sufficiently far about the fixed end causes an inner surface of one of the arms to contact the fixed end and to prevent further displacement of the free end.

According to certain embodiments, the fixed end of the bar contacts an inner surface of the restriction member in at least a pair of contact regions. The pair of contact regions are separated by a no-contact region where the fixed end does not contact the inner surface of the restriction member. In some cases, a friction force is created between the fixed end and the inner surface of the restriction member at each of the contact regions. The friction force created is sufficient to hold the fixed end in contact with the inner surface of the restriction member in the absence of an external force acting on the bar.

In certain embodiments, the free end of the bar and the inner surface of the restriction member are spaced apart by a length A at each of the contact regions and a length B at each of the no-contact regions that is greater than length A. Further, in some embodiments, the bar has a length C that is greater than length A but less than length B such that the bar is compressed at the contact regions between the free end and the restriction member and is not compressed at the no-contact region.

According to another major embodiment, a switch mechanism is provided. The switch mechanism includes an outer frame with an open space defined within the outer frame, and a fixation point is located within the open space of the outer frame. An arm is located within the open space. The arm has a first end mounted to the outer frame and a second end mounted to fixation point. Exerting a force on the outer frame proximate the first end of the arm causes the outer frame to be displaced about the fixation point between two stable positions. The frame remains located at each of the stable positions until acted upon.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
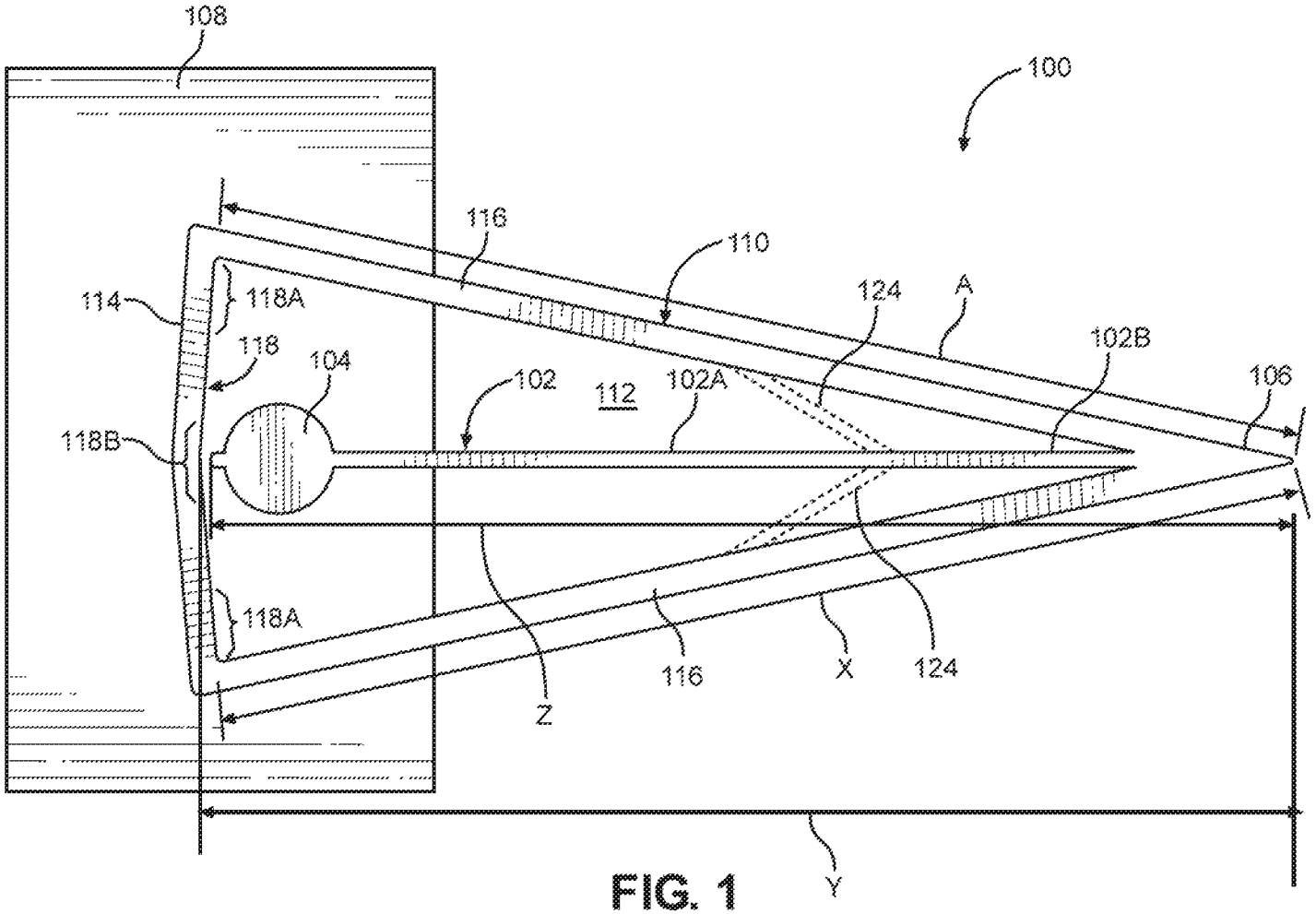
FIG. 1 depicts a compliant buckling switch mechanism in a "neutral" position between two stable positions according to an embodiment of the present invention.
Figure 2A:
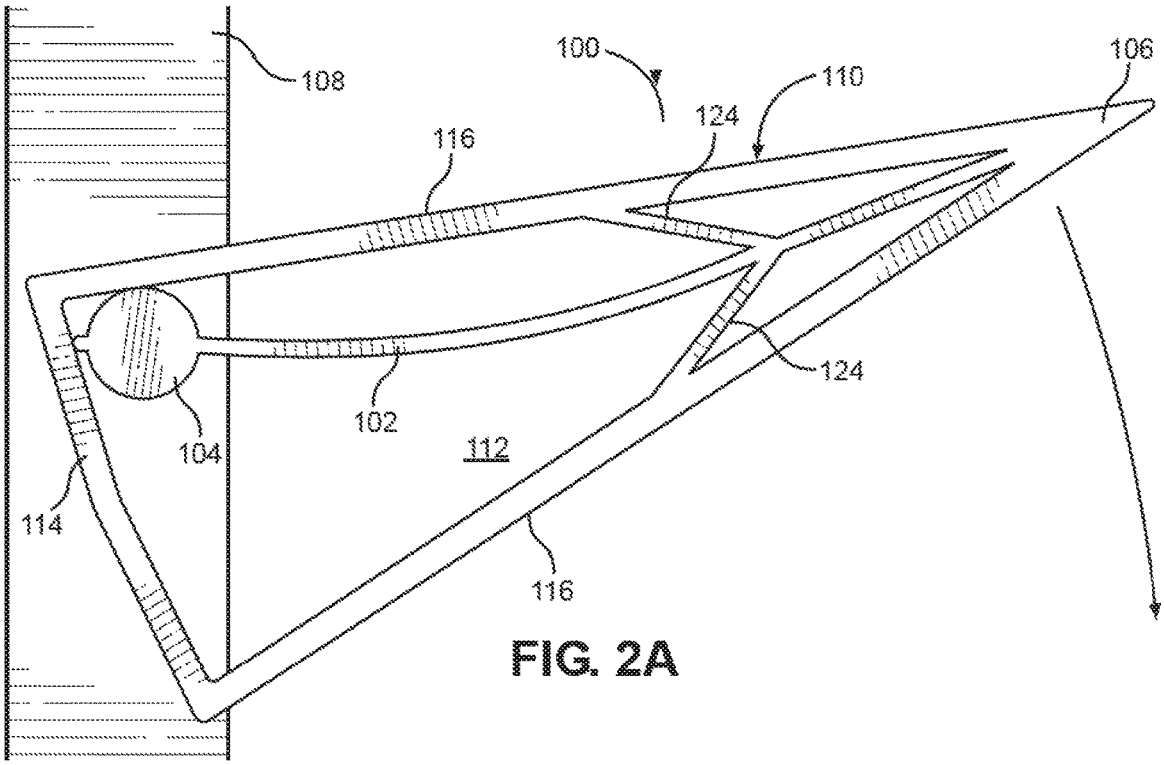
FIG. 2A depicts the switch mechanism of FIG. 1 located in an "A" stable position.
Figure 2B:
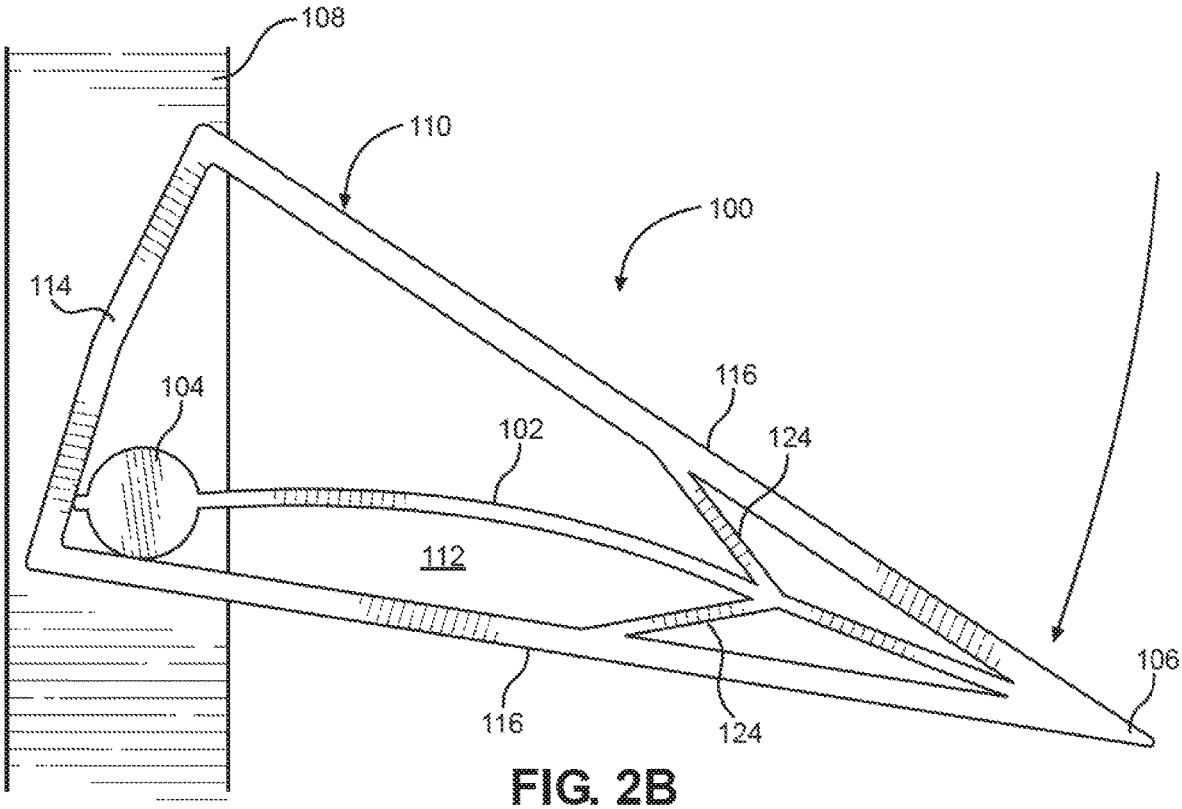
FIG. 2B depicts the switch mechanism of FIG. 2A after moving to a "B" stable position.
Figure 3:
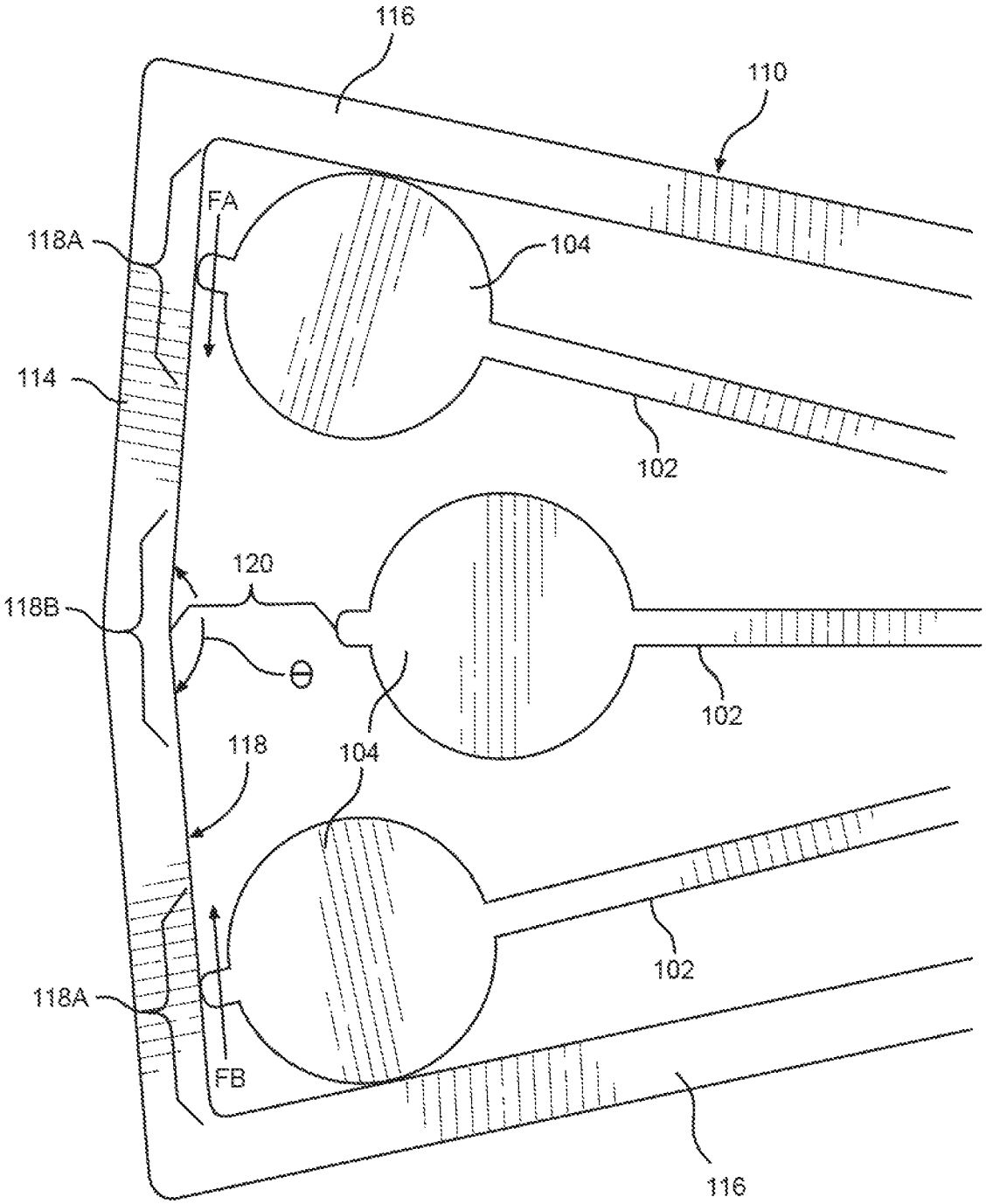
FIG. 3 depicts a portion of an outer frame of a switch mechanism and a fixed end of a bar shown at two contact regions and at a no-contact region that correspond to stable positions and a neutral position of the switch, respectively.

Referring now to the drawings in which like reference characters designate like or corresponding characters throughout the several views, there is shown in FIGS. 1-3, a compliant buckling-type switch mechanism 100 for switching between two stable positions according to an embodiment of the present invention. The switch 100 is configured to move from an initial "neutral" position (FIG. 1) to one of two stable positions, position "A" (FIG. 2A) and position "B" (FIG. 2B).

The switch 100 generally includes a bar 102 mounted to a frame 110. The bar 102 has a fixed end 104 that may be fixedly mounted to a mounting surface 108 and a free end 106 that can move freely. Thus, the bar 102 may be considered to cantilever from the fixed end 104. The bar 102 is thin and flexible such that the free end 106 can move freely with respect to the fixed end 104 from Position A to Position B and vice versa while the fixed end remains fixed. On the other hand, the frame 110 is thicker and substantially more rigid than the bar 102 and it experiences limited or no deformation or flexing when the switch 100 is moved from Position A to Position B. As discussed in greater detail below, the frame 110 is mounted to the bar 102 only at the free end 104. The frame 110 moves about the fixed end 104 as the free end is moved. The frame 110 follows the movement of the free end 106 and bar 102 essentially as a rigid body. As the frame 110 moves, it is designed to contact the fixed end 104 of the bar 102. As the frame 110 continues to rotate about fixed end 104, the free end 106 is drawn nearer the fixed end, which places the bar 102 under compression. This compressive force combined with friction between the frame 110 and the fixed end 104 hold the switch 100 in place at the stable positions. When the switch 100 is moved away from one stable position towards the other stable position, the compression of the bar 102 increases until the critical load is surpassed and the bar buckles, which causes it to shift quickly to the opposite stable position.

The frame 110 includes a restriction member 114 and a pair of arms 116, which are joined together to define an open central space 112. First ends of the arms 116 are connected to ends of the restriction member 114 in spaced apart relation. From there, the arms 116 are angled towards one another and second ends of the arms are connected together with one another to completely enclose the frame 110. The fixed end 104 of the bar 102 is located within the open space 112 of the outer frame 110 adjacent the restriction member 114 and the free end 106 of the bar is mounted to the arms 116 of the frame such that the bar is located entirely within and extends across the open space 112.

The bar 102, the frame 110, and the mounting surface 108 may be manufactured separately from one another and then connected together. However, the switch 100 is preferably, though not required to be, "monolithic" or formed using single-piece construction. In other embodiments, the switch 100 is partially formed as a single piece. For example, the bar 102 and the frame 110 may be formed as a single component that is separate from the mounting surface 108. An advantage of fabricating the bar 102 separate from the mounting surface 108 is portability. The bar 102 may be configured to mount to any stable surface and that stable surface would function as the mounting surface 108. For example, a bolt may be inserted through the fixed end 104 and secured to the underlying mounting surface 108. In each case, the fixed end 104 is the sole connection point between the frame 110 and bar 102, on one hand, and the mounting surface 108, on the other hand. An advantage of manufacturing the switch 100, particularly the bar 102 and the frame 110, as a single piece is that this type of construction requires significantly fewer components than conventional switches that have a large number of separate components. Single piece design means there are no hinges, latches, or hooks to be maintained, which simplifies its operation and reduces the costs of maintenance and replacement. Efficient manufacturing techniques, such as 3D printing applications, can be used to construct the switch 100 from a virtually any material required by the intended application.

Frame 110 can act to limit the movement of the switch so that its travel stops automatically once one of the stable positions has been reached. As shown in FIG. 3, the frame 110 is designed so that an inner surface 118 of the restriction member 114 and an arm 116 are brought into contact with the fixed end 104 in at least two locations ("contact regions") 118A as the frame moves about the fixed end. These contact regions 118A correspond with the stable positions of the switch 100. As such, when the switch 100 is moved to Position A or Position B, the fixed end 104 contacts one of the two contact regions 118A and one of the arms 116, which automatically stops the movement of the switch. Bar 102 angles upwards from the fixed end 104 to the free end 106. The fixed end 104 is located at the top of open space 112 and contacts the top of the frame 110, including the restriction member 114 and the top arm 116. In the B position (FIG. 2B), the bar 102 angles downwards from the fixed end 104 to the free end 106. The fixed end 104 is positioned at the bottom of open space 112 and contacts the bottom of the frame 110, including the restriction member 114 and the bottom arm 116. The contact regions 118A are separated by a "no contact region" 118B, where the inner surface 118 of the restriction member 114 is brought out of contact with the fixed end 104. The no-contact region 118B corresponds with the neutral position. The no-contact region 118B is important so that the switch 100 can quickly and easily move between Positions A and B once a critical load is applied to the bar 102 and without the need for any additional energy input. Accordingly, as shown above, this design causes the switch 100 to stop automatically at the stable positions (Position A and Position B) while also allowing the switch to quickly and easily switch between stable positions.

To achieve the intermittent contact between the free end 104 and the inner surface 118 of the restriction member 114, the inner surface is contoured (i.e., non-linear) and the bar 102 and frame 110 are sized such that they are brought into contact with the fixed end 104 as the switch 100 is rotated from the neutral position to either Position A or Position B. The inner surface 118 of the restriction member 114 may have any desired contour shape (e.g., circular) that provides the desired intermittent contact between the free end 104 and the inner surface 118. In this particular case, the inner surface 118 includes two straight portions joined together at an angle Θ. In this embodiment, the angle Θ is approximately 150-170°. The free end 106 of the bar 102 and the inner surface 118 of the restriction member are spaced apart by a length X at each of the contact regions 118A and a length Y at the no-contact region 118B. The bar 102 has a length Z that is greater than length X but less than length Y. Put simply, the length of the bar 102 (i.e., length Z) is greater than the distance between the free end 106 and the contact regions 118A (i.e., length X) and less than the distance between the free end and the no-contact region 118B (i.e., length Y). This creates an offset 120 (FIG. 3) between the fixed end 104 and the no-contact region 118B. As a result of the offset 120, the bar 102 does not contact the no-contact region 118B. However, the bar 102 does contact each of the contact regions 118A. In one functioning example, the following lengths were utilized: length X=3.53 inches; length Y=3.56 inches; and length Z=3.55 inches.

Not only is the switch 100 designed to stop automatically once positioned at the stable positions and, when desired, to switch quickly between stable positions, but it is also designed to securely hold those positions at all other times without energy input. The primary mechanism for holding the switch 100 at each of the stable positions is friction that develops between the bar 102 and the frame 110. Since the length of the bar 102 (i.e., length Z) is greater than the distance between the free end 106 and the contact regions 118A (i.e., length X), the bar must deform by compressing and bowing outwards in order to be located at the contact regions. Thus, as the free end 106 is moved from the neutral position towards Position A or Position B, the frame 110 moves about the fixed end 104 and the inner surface 118 of the restriction member 114 is brought nearer and eventually contacts the fixed end 104 once a stable position is reached. The bar 102 bows outwards in a first direction or a second direction, depending on the position of the free end 106 (i.e., Position A or Position B), as illustrated in FIGS. 2A and 2B. With reference to FIG. 3, the contact between the fixed end 104 and the contact regions 118A creates friction forces $F_A$, $F_B$, which assist in holding the switch 100 at the stable positions. In the absence of the friction forces $F_A$, $F_B$, the switch 100 would tend to move back to the neutral position. In Position A, without friction, the restriction member 114 would tend to move upwards over the fixed end 104, so friction force $F_A$ is oriented downwards and resists this upwards travel. Similarly, in Position B, without friction, the restriction member 114 would tend to move downwards below the fixed end 104, so friction force $F_B$ is oriented upwards and resists this downwards travel.

The friction forces $F_A$, $F_B$ effectively pin the bar 102 at the stable locations, including as the free end 106 is moved. This enables the free end 106 to be moved from Position A towards Position B, and vice versa, while the frame 110 remains in constant contact with the fixed end 104. This movement requires the bar 102 to straighten from its outwardly bowed state and then begin to bow in the opposite direction, which increases the compressive load in the bar 102. This increased compression enables the critical compressive load to be reached, which, as discussed above, makes the bar 102 susceptible to buckling. Continued movement of the free end 106 once the critical load has been reached results in a sudden transverse deflection that moves the switch 100 from one stable position to the opposite stable position. This process is illustrated in FIGS. 4-7 and is discussed in more detail below.

Figure 4:
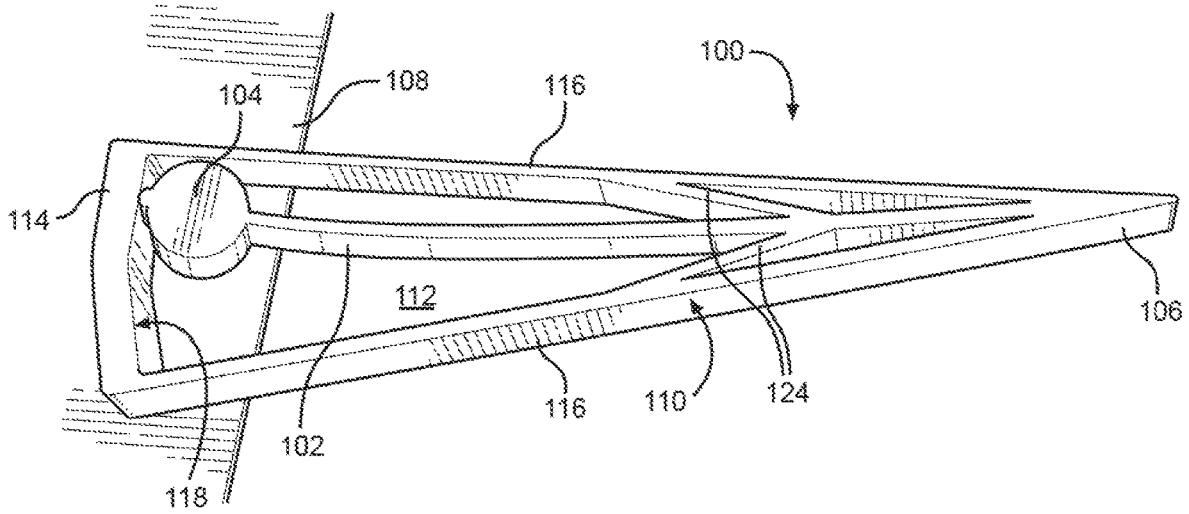
FIGS. 4-7 illustrate the process of moving the switch mechanism of FIGS. 2A and 2B from the "A" stable position to the "B" stable position.
Figure 7:
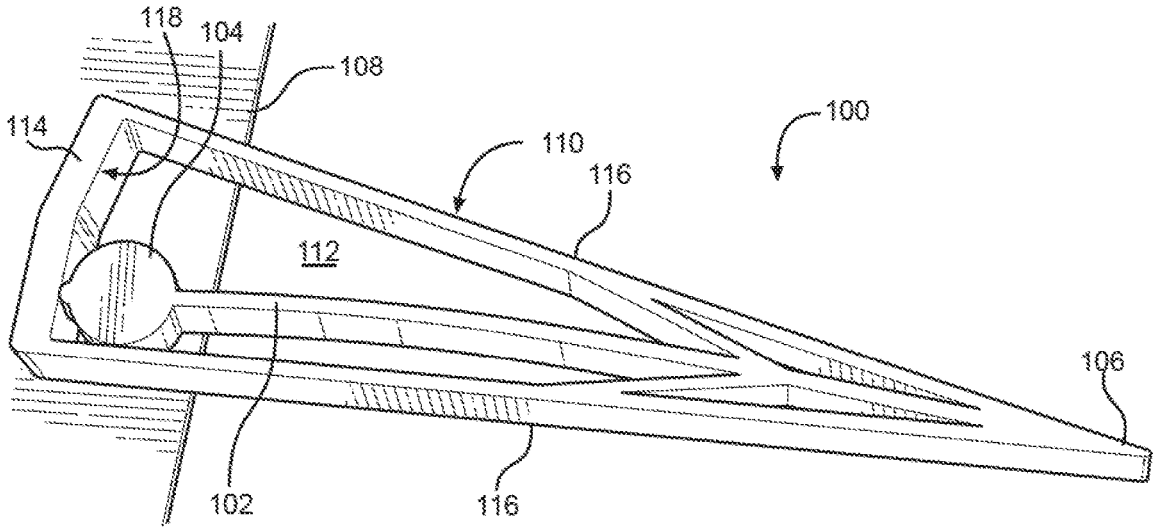

The switch 100 is shown initially in stable Position A in FIG. 4. The process described below will result in the switch 100 being moved to stable Position B, as shown in FIG. 7. In each case, the fixed end 104 has made contact with an arm 116 and the restriction member 114, which has caused movement of the switch 100 to stop when the switch is located at a stable position. Additionally, as evidenced by the bowed shape of the bar 102 extending from the fixed end 104 to the free end 106, the bar has been placed under a compressive load in each of the stable positions. Due to the compliant nature of the switch 100, the compression of the bar 102 causes it to function similar to a spring and to store energy. In trying to release this stored energy, the bar 102 acts like a spring and pushes against both the fixed end 104 and the free end 106. While the fixed end 104 is fixed and cannot move, the free end 106 can move. The spring force provided by the bar causes the outer frame 110 to be shifted and the contact region 118A of the restriction member 114 is brought into contact with the fixed end 104. This creates friction between the fixed end 104 and the frame 110 that helps to securely hold the switch 100 in the selected stable position.

Figure 5:
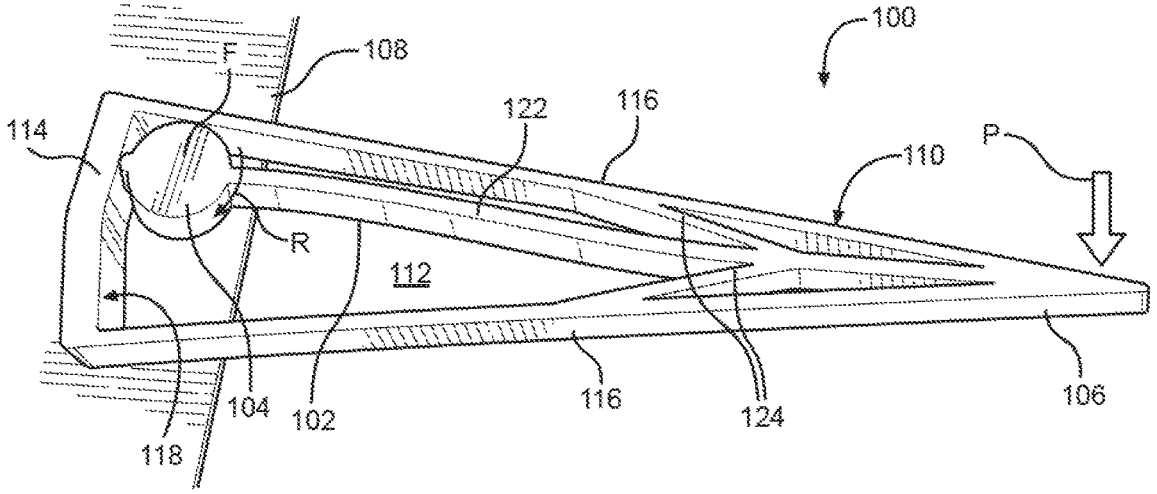
Figure 6:
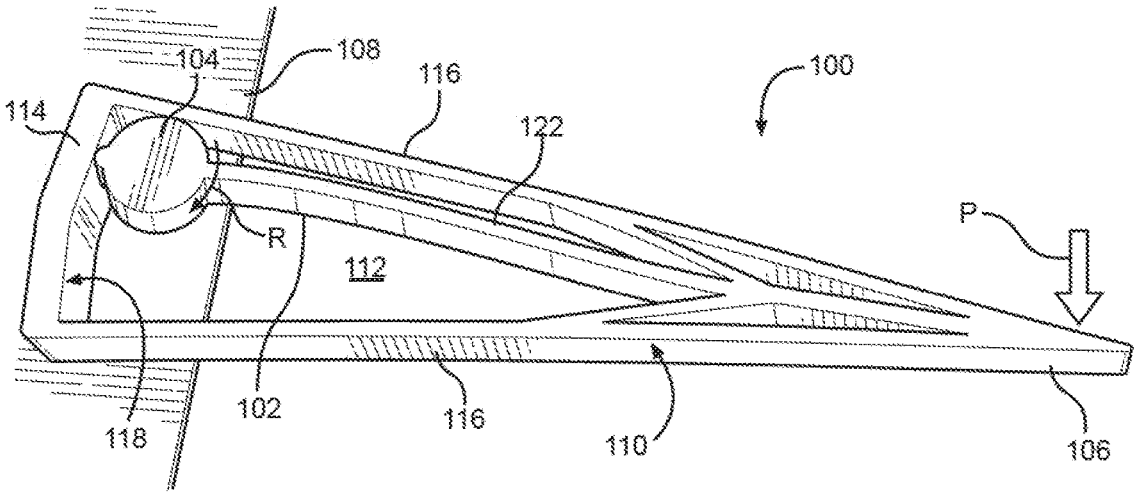

The transitional stages between Position A and Position B are illustrated in FIGS. 5 and 6. Exerting a transitional force P to the switch 100 causes the switch to begin moving from Position A to Position B. The force P is applied in an opposite direction to move the switch 100 from Position B back to Position A. In either case, moving the bar 102 from initial Position A (FIG. 4) to final Position B (FIG. 7) or vice versa requires the bar 102 to be straightened by moving the free end 106 about the fixed end 104. This straightening process further compresses the bar 102, in the transitional stages, beyond its already-compressed state at each of the stable positions. The increased compression combined with the movement of the free end 106 with respect to the fixed end 104 causes the bar 102 to bend, as indicated by inflection point 122. Continuing to apply force P to the switch 100 causes even more dramatic bending to occur, as shown by the more pronounced inflection point 122 in FIG. 6. Eventually, the compression of the bar 102 reaches the critical load. At that point, continued movement of the free end 106 causes the bar 102 to buckle and to shift sharply from one stable position to the opposite stable position. Following this shift, the stress in the bar is released. However, since the bar is automatically positioned in the opposite stable position, the bar 102 is automatically compressed again when moved to the opposite stable position. As discussed above, maintaining this preload compressive stress is important for maintaining the switch 100 in the desired stable position. Thus, due to the compression of the bar 102 at each of the stable positions, the preload stress is greater when the free end 106 is at each of the stable positions than when the free end is at a neutral position located between the stable positions.

For switches embodying the presently disclosed design, a minimum amount of compression of the bar 102 is required to cause buckling to occur so that the switch 100 can move between the first stable position and the second stable position. As discussed above, the bar 102 must be rotated and straightened to enable this level of compression to be reached. As discussed above, this straightening is possible because both ends of the bar 102 are essentially pinned within the frame 110. The fixed end 104 is the axis of rotation when force P is applied to the bar 102 and about which the free end 106 tends to rotate.

Exerting force P to the bar 102 at some distance away from the fixed end 104 produces a moment force or a resultant torque R that causes the bar 102 to straighten. The torque R is equal to the distance between the fixed end 104 and the site where force P is applied multiplied by the component of force P that is perpendicular to the bar 102. Increasing or decreasing the distance between force P and the fixed end 104 increases or decreases the resultant torque R, respectively. As such, a higher force P is required to cause buckling in the bar 102 if that force is applied near the fixed end 104, and a lower force P is required to cause buckling in the bar if that force is applied further from the fixed end.

An advantage of the present switch design over prior designs is that the force P may be applied at the very end of the bar 102, which maximizes the leverage and resultant torque R for a given applied force P. This is only possible because only one end of the bar 102 is fixed and the opposite end is free to move with respect to the fixed end. If both ends of the bar 102 were fixed, the applied force P could not be applied at the very end of the bar. Instead, that force must be applied at some location between the ends, which shortens the moment arm and reduces the moment force the can be obtained for a given applied force P. Accordingly, the current design enables a larger resultant torque R to be attained for a given applied force P and bar length over designs having both ends of the bar fixed. This design also enables an equivalent resultant torque to be obtained with a smaller bar length or a smaller applied force than in systems where both ends of the bar are fixed. Thus, an advantage of this design over designs having both ends of the bar fixed is that this design allows for actuation with lower energy requirements and smaller components.

The critical load required to cause buckling in a long straight column, such as the bar 102, is a function of the unsupported length of the column. This relationship is described by Euler's formula provided below:

$$P_{cr} = \frac{\pi EI}{L^2}$$

where $P_{cr}$ is the critical load required for buckling to occur, E is the modulus of elasticity of the material, I is the moment of inertia of the cross section, and L is the unsupported length of the beam. From the equation above, it can be seen that the critical load ($P_{cr}$) increases or decreased inversely with the unsupported length of the beam (L).

As shown in FIG. 1, $P_{cr}$ may be increased by adding one or more stiffening struts 124 to reduce the unsupported length. Without the stiffening struts 124, essentially the entire length of the bar 102 is unsupported. However, the unsupported length of bar 102 can be shortened by connecting stiffening struts 124 between the bar 102 and the frame 110. The stiffening struts 124 divide the arm into a first portion 102A between the strut 124 and the fixed end 104 and a second portion 102B between the strut 124 and the free end 106. The first portion 102A readily bends as the free end 106 is moved. The second portion 102B experiences limited (if any) bending as the free end 106 is moved. As the stiffening struts 124 are moved closer towards the fixed end 104, the unsupported length of the first portion 102A is reduced and the bar 102 becomes stiffer. This increases the transitional force P required to achieve buckling and also decreases the displacement of the switch 100 for a given force P. Conversely, moving the stiffening struts 124 towards the free end 106 increases the unsupported length of the first portion 102A of the bar 102 and the bar becomes more flexible, which decreases the force P required to achieve a critical load and increases the displacement of the switch 100 for a given force P. This allows for a number of design choices. For example, achieving the critical load in a more flexible switch 100 would require a larger displacement of the free end 106 than in a stiffer switch. Thus, by adding, repositioning, or removing stiffening struts 124, the force P and amount of displacement (i.e., range of motion) required to operate the switch can be adjusted.

The switch 100 may be scaled to any size to adjust the desired parameters of the switch 100, including down to micro- or nano-sizes, depending on the application of the switch. Accordingly, this design is appropriate for a range of applications including, but not limited to, microelectromechanical systems (MEMS), optical switches that might be used in connection with fiber optics or other applications, drug delivery applications, biomedical applications, microvalves, micro-pumps, mechanical memory devices, and also conventional mechanical switches. The input force required to move between stable states may be changed by scaling the switch to vary the stiffness of its elements. In many cases, there exists a linear relationship between the size of a component and its stiffness. Generally, larger components are stiffer and, therefore, require a higher input force to achieve a desired displacement than smaller components. While the design of the switch 100 is scalable to any size, other factors, such as the size of components that the switch must interact with (e.g., actuators), will determine the how large or small the switch may be made.

The switch 100 may be formed from a wide variety of materials (metals, polymers, etc.), depending on application, environment, cost, and other design considerations. For example, certain materials are preferred for electrical applications, whereas other materials are preferred for mechanical applications. Selection of materials based on application, environmental, cost, and other factors is well known in the art. Changing the material type and material properties will change the force-displacement relationship of the compliant switch 100. Accordingly, while maintaining the using the same overall design, the input force required to move between stable positions can be varied by changing the material used.

Lastly, in an alternate embodiment, the free and fixed ends 104, 106 may be swapped, while still maintaining the general structure of the device. In that case, the free end 106 of the bar 102 may be attached to an immovable surface and the fixed end 104 may be attached to a surface that is able to swing freely.

The foregoing description of preferred embodiments for this disclosure have been presented for purposes of illustration and description. They are not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the invention in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A switch mechanism comprising: a compliant buckling bar having a single fixed end configured to mount to a mounting surface and a free end configured for displacement with respect to the fixed end between two stable positions in response to a transition force exerted on the switch mechanism;

a triangular shaped frame including:

a restriction member spaced apart from the free end of the bar such that the fixed end of the bar is positioned between the restriction member and the free end;

two arms having first ends connected to the restriction member and second ends connected to one another and to the bar proximate the free end;

an open central space defined within the triangular shaped frame;

wherein the fixed end of the bar is located in the open central space; and wherein, in response to the transition force, the restriction member is displaced with respect to the fixed end of the bar as the arms and the free end of the bar are moved with respect to the fixed end; and wherein an inner surface of the restriction member comprises a pair of contact regions separated by a no-contact region and wherein contact is made between each of the contact regions and the fixed end and no contact is made between the no-contact region and the fixed end as the switch is moved from one stable position to the opposite stable position.

2. The switch mechanism of claim 1, wherein the free end of the bar and the inner surface of the restriction member are spaced apart by a length X at each of the contact regions and a length Y at each of the no-contact regions, wherein length Y is greater than length X.

3. The switch mechanism of claim 2 wherein the bar has a length Z that is greater than length X but less than length Y such that the bar is compressed at the contact regions and is not compressed at the no-contact region.

4. The switch of claim 1 wherein a friction force is created between the fixed end and the inner surface of the restriction member at each of the contact regions, wherein the friction force created is sufficient to hold the fixed end in contact with the inner surface of the restriction member in the absence of an external force acting on the bar.

5. The switch mechanism of claim 1 wherein displacing the free end of the bar about the fixed end causes an arm to contact the fixed end and to prevent further displacement of the free end.

6. The switch mechanism of claim 1 wherein mounting the fixed end to the mounting surface constitutes the only fixed connection between the bar and the mounting surface.

7. A switch mechanism comprising: a compliant buckling bar having a single fixed end configured to mount to a mounting surface and a free end configured for displacement with respect to the fixed end between two stable positions in response to a transition force exerted on the switch mechanism; wherein preload stress in the bar is higher when the free end is at each of the stable positions than when the free end is at a neutral position located between the stable positions.

8. A switch mechanism comprising:

an outer frame formed from first and second arms connected together at one end thereof and a restriction member connected between the first and second arms at an opposing end thereof;

an open space defined within first and second arms and restriction member of the outer frame;

a fixation point located within the open space of the outer frame;

a bar disposed within the open space having a first end mounted to the outer frame and a second end configured to mount to a fixation point located within the open space of the outer frame, wherein, when the bar is mounted to the fixation point, exerting a force on the outer frame causes the outer frame to be displaced about the fixation point and, after a predetermined displacement, the frame remains fixed at one of two stable positions; and one or more stiffening struts mounted between the frame and the bar.

9. A method of switching comprising the steps of:

providing a monolithic compliant bi-stable bar having a fixed end configured to mount to a mounting surface and a free end configured to be displaced about the fixed end between two stable positions;

mounting the fixed end to said mounting surface;

moving the bar to a first stable position by exerting a force on the bar;

switching the bar from the first stable position to a second position by exerting a force on the bar, wherein the bar is initially moved to the first stable position by exerting a force in a first direction and is moved to the second position by exerting a force in a second direction;

providing a restriction member spaced apart from the free end of the bar such that the fixed end of the bar is positioned between the restriction member and the free end;

providing arms having first ends that are connected to the restriction member and second ends that are connected to the bar proximate the free end, such that a central space is defined within the arms and the restriction member and such that the fixed end of the bar is located in the central space;

wherein, during the step of exerting a force on the free end, the restriction member is moved around the fixed end of the bar; and contacting the fixed end of the bar with an inner surface of the restriction member at the first stable position.

10. The method of claim 9 further comprising contacting the fixed end of the bar with an inner surface of the restriction member at a second stable position.

11. The method of claim 10 comprising compressing the bar at each of the first and second stable positions and removing all compressive stress from the bar at a neutral location between the stable positions.

12. The method of claim 9 wherein, as a result of the contact between the fixed end and the inner surface of the restriction member, a friction force is generated between the fixed end and the inner surface of the restriction member that causes the free end to remain fixed in place.

13. The method of claim 9 wherein, as a result of the contact between the fixed end and the inner surface of the restriction member and the movement of the free end with respect to the fixed end from the first stable position to the second stable position, a compressive force in the arm increases and exceeds a critical load necessary for buckling such that the arm buckles.

* * * * *